United States Patent [19]

Stull

[11] 4,293,314

[45] Oct. 6, 1981

[54] GELLED FUEL-AIR EXPLOSIVE METHOD

[75] Inventor: Bertram O. Stull, Ridgecrest, Calif.

[73] Assignee: The United States of America as represented by the Secretary of the Navy, Washington, D.C.

[21] Appl. No.: 111,453

[22] Filed: Jan. 11, 1980

[51] Int. Cl.[3] ..... C10L 7/00

[52] U.S. Cl. ..... 44/7 A; 44/7 R; 44/7 D; 102/90; 102/363

[58] Field of Search ..... 102/90; 44/7 R, 7 E, 44/7 D, 7 A

[56] References Cited

U.S. PATENT DOCUMENTS

| | | | |
|---|---|---|---|
| 3,539,311 | 11/1970 | Cohen et al. | 44/7 A |
| 3,634,157 | 1/1972 | Batson | 44/7 E |
| 3,685,453 | 8/1972 | Hawrick | 102/90 |
| 3,730,093 | 5/1973 | Cummings | 102/90 |
| 3,795,556 | 3/1974 | Sippel et al. | 44/7 E |
| 3,955,509 | 3/1976 | Carlsen | 102/90 |
| 3,994,696 | 11/1976 | Adicoff | 44/7 A |
| 4,157,928 | 6/1979 | Falterman et al. | 102/90 |

*Primary Examiner*—Edward A. Miller
*Attorney, Agent, or Firm*—R. S. Sciascia; W. Thom Skeer; Lloyd E. K. Pohl

[57] ABSTRACT

1, 2-Butylene oxide as a fuel for a fuel air explosive weapon. The oxide may be used either as a pure liquid or gelled with a gelling agent such as silicon dioxide, particulate carbon or aluminum octoate.

3 Claims, No Drawings

GELLED FUEL-AIR EXPLOSIVE METHOD

BACKGROUND OF THE INVENTION

1. Field of the Invention

This invention relates to fuels for fuel air explosive weapons. More particularly, this invention relates to a method for causing an explosion comprising the steps of dispersing a cloud of liquid fuel in the air and detonating the cloud wherein the cloud is composed of particles of gelled or ungelled 1,2-butylene oxide.

1. Description of the Prior Art

Fuel air explosive weapons are now well known. A typical example of one is depicted in U.S. Pat. No. 3,955,509 which was issued to Gary A. Carlson on May 11, 1976.

Fuel air explosive weapons may be described as devices which, upon activation, cause liquid fuel particles to be dispersed in the form of a detonable cloud in the air and then detonate the cloud.

A number of fuels have been used in fuel air explosive weapons. Among these are ethylene oxide and propylene oxide. Because of the ease with which is cloud of ethylene oxide or propylene oxide can be detonated, these two materials are the most commonly used. However, these fuels have certain drawbacks.

One drawback, common to both ethylene oxide and propylene oxide, is toxicity. Both materials are highly toxic. A concentration of 50 parts per million of ethylene oxide in the air may have harmful effects on one breathing the air for about 8 hours. Propylene oxide is less toxic than ethylene oxide but is still highly toxic. A concentration of 100 parts per million of propylene oxide breathed for about 8 hours may have undesirable effects. Naturally, when fuel air explosive devices are stored in a confined area such as aboard a ship, exposure for 8 hours is not unusual.

Another drawback common to ethylene oxide and propylene oxide is the fact that both have relatively low boiling points, 10.4° C. and 34.2° C. respectively. This makes the two difficult to handle in loading operations. High vapor pressures also contribute to difficulty in handling.

A drawback particularly associated with ethylene oxide is its tendency to polemerize during storage. Left alone in a fuel air explosive weapon or other container, ethylene oxide tends to self polemerize. The polymerized material is unsuitable for use as a fuel for a fuel air explosive device. Unpolymerized ethylene oxide, on the other hand is highly desirable as a fuel insofar as detonability is concerned. Clouds containing from as little as 3 up to as much as 100 percent by volume of ethylene oxide are detonable. The detonation limits of propylene oxide, on the other hand, range from about 3.1 to about 27.5 percent by volume.

SUMMARY OF THE INVENTION

It has now been found that 1,2-butylene oxide, when used as a fuel for fuel air explosive devices, exhibits marked superiority over either ethylene oxide or propylene oxide. The marked superiority stems from the fact that 1,2-butylene oxide is about 3 times safer than propylene oxide when long exposure to it is required and about 3.5 times safer than ethylene oxide. Insofar as ease of detonation is concerned, 1,2-butylene oxide has about the same explosive limits as propylene oxide. However, 1,2-butylene oxide is significantly easier to handle because its boiling point is nearly twice that of propylene oxide-63° C. as opposed to 34.2° C.-and over 6 times that of ethylene oxide. According to this invention 1,2-butylene oxide may be used in either its natural liquid state or gelled with a hereinafter named gelling agent.

DESCRIPTION OF THE PREFERRED EMBODIMENTS

In one embodiment of this invention, neat 1,2-butylene oxide liquid is used as the fuel in a fuel air explosive weapon in lieu of the previously most commonly used fuels, ethylene oxide and propylene oxide. It has been found that butylene oxide is significantly less toxic than either of the two commonly used oxides. Air containing 400 parts per million of 1,2-butylene oxide may be breathed safely for up to 8 hours with no undesirable results as compared to 100 parts per million for propylene oxide and only 50 parts per million for ethylene oxide.

1,2-butylene oxide offers a second distinct advantage over ethylene oxide and propylene oxide. Its boiling point is 63° C. as opposed to 10.4° C. and 34.2° C. respectively for the other two oxides. Thus, loading operations are much easier to carry out. No special equipment is needed for its handling.

Tests have shown that, insofar as ease of detonation is concerned, 1,2-butylene oxide is similar to propylene oxide. Its explosive limits range from about 3.1 to 25.1 percent by volume as opposed to 3.1 to 27.5 percent by volume for propylene oxide. Thus, its significantly lower toxicity can be taken advantage of with very little loss in explosive efficiency.

Another factor contributing to the ease of handling of 1,2-butylene oxide is its vapor pressure. The vapor pressure of 1,2-butylene oxide is only 207.0 mm Hg at 25° C. as opposed to 1,292.0 for ethylene oxide and 569.0 for propylene oxide.

In a second embodiment of this invention, 1,2-butylene oxide may be used in a gelled state. It has been found that, if 1,2-butylene oxide is gelled by adding about 3 to about 10 weight percent of a gelling agent such as $SiO_2$ (Cab-O-Sil), particulate carbon or aluminum octoate, it will still be dispersed into a detonable cloud by a typical fuel air explosive weapon. This is perhaps the best mode of practicing this invention for several reasons. First, the gel is more easily handled than the neat liquid. Second, if spilled the gel will not disperse as a liquid will.

In storage, no self-polymerization of 1,2-butylene oxide has been detected. Thus, a warhead loaded with the material has an indefinite shelf-life.

I claim:

1. In a method for producing an explosion comprising the steps of dispersing a cloud of liquid particles in the air and detonating the cloud, the improvement residing in utilizing 1,2-butylene oxide in gel form as said liquid.

2. A method according to claim 1 wherein said gel consists essentially of 1,2-butylene oxide and a gelling agent selected from the group consisting of $SiO_2$, particulate carbon and aluminum octoate.

3. A method according to claim 2 wherein said gelling agent is present in an amount in the range of from about 3 to about 10 weight precent.

* * * * *